US005803448A

United States Patent [19]

Stiel et al.

[11] Patent Number: 5,803,448

[45] Date of Patent: Sep. 8, 1998

[54] DEVICE FOR THE SUSPENDED GUIDANCE OF SHEETS OR WEBS

[75] Inventors: Jürgen Alfred Stiel, Thüngen; Volkmar Rolf Schwitzky, Würzburg, both of Germany

[73] Assignee: Koenig & Bauer-Albert Aktiengesellschaft, Wurzburg, Germany

[21] Appl. No.: 696,849

[22] PCT Filed: Mar. 1, 1995

[86] PCT No.: PCT/DE95/00262

§ 371 Date: Aug. 30, 1996

§ 102(e) Date: Aug. 30, 1996

[87] PCT Pub. No.: WO95/23755

PCT Pub. Date: Sep. 8, 1995

[30] Foreign Application Priority Data

Mar. 3, 1994 [DE] Germany ..... 44 06 847.6

[51] Int. Cl.[6] ..... B65H 29/24

[52] U.S. Cl. ..... 271/195

[58] Field of Search ..... 271/195, 194, 271/196, 211; 406/88; 226/97

[56] References Cited

U.S. PATENT DOCUMENTS

| | | | |
|---|---|---|---|
| 3,633,281 | 1/1972 | Vits . | |
| 4,197,621 | 4/1980 | Mair . | |
| 4,218,001 | 8/1980 | Vits . | |
| 5,102,118 | 4/1992 | Vits . | |
| 5,687,964 | 11/1997 | Stephan et al. | 271/195 |

FOREIGN PATENT DOCUMENTS

| | | |
|---|---|---|
| 0 250 651 | 1/1988 | European Pat. Off. . |
| 1 907 083 | 9/1970 | Germany . |
| 28 02 610 | 7/1979 | Germany . |
| 89 15 626 | 4/1991 | Germany . |

*Primary Examiner*—David H. Bollinger
*Attorney, Agent, or Firm*—Jones, Tullar & Cooper, P.C.

[57] ABSTRACT

Sheets or a web of material are suspended and guided by a plurality of nozzles that direct air out from a closed guidance surface. The nozzles are arranged in a central stabilizing zone and two tightening zones. The air delivered in these zones is directed generally opposite to the conveying direction of the sheets or web and away from a longitudinal axis of symmetry of the closed guidance surface.

6 Claims, 3 Drawing Sheets

DEVICE FOR THE SUSPENDED GUIDANCE OF SHEETS OR WEBS

FIELD OF THE INVENTION

The present invention relates to a device for the suspended guidance of sheets or webs in processing machines, in particular rotary printing presses.

DESCRIPTION OF THE PRIOR ART

DE-PS 19 07 083 describes a blowing chamber with several blower openings disposed in a distributed manner, which openings respectively have an oblique guide surface extending downward into the blowing chamber. However, in this case, the nozzles have a tongue and the radial guide surfaces enclose an angle between 120° and 180°. By means of this, a widely fanned out jet with a flat effect is generated, not a directed jet. Also, all blowing nozzles are disposed in the same direction. By means of this, it is possible to exert a barely tightening force in only one direction, which is particularly disadvantageous with thin sheets, because they easily tend to flutter because of this.

DE-PS 28 02 610 discloses nozzles, the lateral surfaces of whose oblique guide surfaces extend parallel and are provided with a lowered tongue. These nozzles are disposed closely together next to each other on blowing chambers. A guide path is described, which consists of several blowing chambers which are disposed above and below of sheets to be guided. No closed guide surface results from this. The air flows off through gaps created between the individual blowing chambers, so that no even air cushion is created and the sheets are guided along the guide path in a wave shape. It is disadvantageous in connection with the described nozzles that the emerging air jets do no diverge, so that a large number of nozzles are required for building a homogeneous air cushion.

A device in accordance with the species for the suspended guidance of sheets or webs in processing machines is known from DE 89 15 626 U1. Here, the blowing jets extend in the center of the device approximately parallel with the direction of conveyance, and in the adjoining areas extend away in steps from the conveying device.

With this device it is disadvantageous that the blowing jets of this device cause thin sheets in particular to begin fluttering.

SUMMARY OF THE INVENTION

It is the object of the invention to create a device by means of which sheets or webs are guided contactless and are tightened in the direction of free edges through a processing machine, preferably a rotary printing press, without blowing jets being generated which tend to form waves, i.e. which tend to create fluttering.

This object is attained in accordance with the invention by means of a device which is provided with a plurality of nozzles that are inserted into an otherwise closed sheet guidance surface that is facing the sheets or web being guided. The nozzles are arranged to divide the guidance surface into at least three zones across its width. These zones are a central stabilizing zone and two tightening zones. The nozzles in the two tightening zones direct air flow out from an axis of symmetry and generally in a direction opposite to the sheet or web conveying direction.

It is achieved by means of the nozzles in accordance with the invention, and their arrangement, that a particularly even air cushion is formed over an entire guidance surface. By means of this air cushion, a sheet or a web is simultaneously supported and aspirated because of the effect of the aerodynamic paradox. In spite of this even air cushion, in which the suction and pressure forces are in an equilibrium, directed, slightly diverging flows of the nozzles exert forces for tightening in defined directions. In an advantageous manner these forces are directed to free edges of the sheet.

A division of the guidance surface into three zones across its width, a central stabilization zone, and right and left tightening zones has been shown to be particularly advantageous.

An even air cushion is generated in this area of the guidance surface by means of the stabilization zone located symmetrically with an axis of symmetry, which simultaneously exerts a tightening effect on the sheet opposite the conveying direction F and acts counter to the injector effect generated in the tightening zones i.e. air is removed from the stabilization zone.

Tightening zones adjoin both sides of the stabilization zone, in which the nozzles, pointing away in a conveying direction F from the axis of symmetry, enclose an angle between 120° to 180° or −120° to −180°. A tightening effect in the direction of the trailing edges of the sheets is generated in the tightening zones, and at the same time air is removed from the stabilization zone as well as from the tightening zone. In this way the height of the air cushion cannot increase viewed in the conveying direction F.

In an arrangement that is particularly suited for thin unstable sheets which have a strong tendency to flutter, the nozzles are directed in such a way that each blowing jet is disrupted by a second air jet blowing at approximately right angles to the first, so that no wave generation is caused by a continued jet, i.e. the blowing jet of each nozzle extends in a straight line only over a short distance. By means of two prevailing blowing directions, which are directed essentially perpendicularly in respect to each other, fluttering, i.e. wave generation moving in the blowing direction, is suppressed.

In this case the resultants of the blowing direction of the nozzles nevertheless exhibit edges in the trailing direction for achieving the desired tightening effect.

BRIEF DESCRIPTION OF THE DRAWINGS

The device for the suspended guidance of sheets or webs in accordance with the invention is represented in the drawings and will be described in more detail below.

DESCRIPTION OF PREFERRED EMBODIMENT

Figure 1:
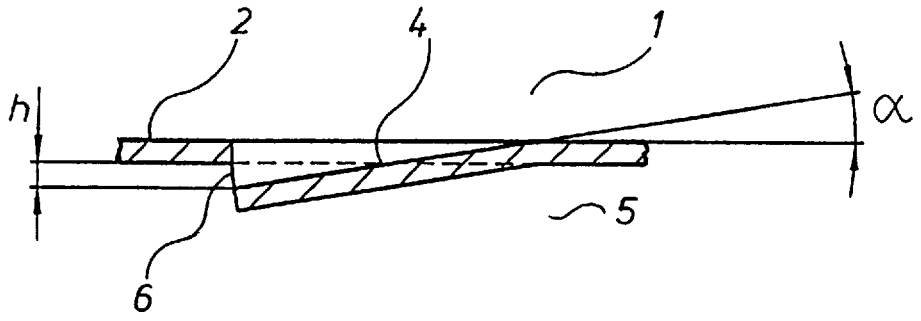
FIG. 1 is a section through the device in accordance with the present invention in the area of a nozzle in the longitudinal direction.
Figure 2:
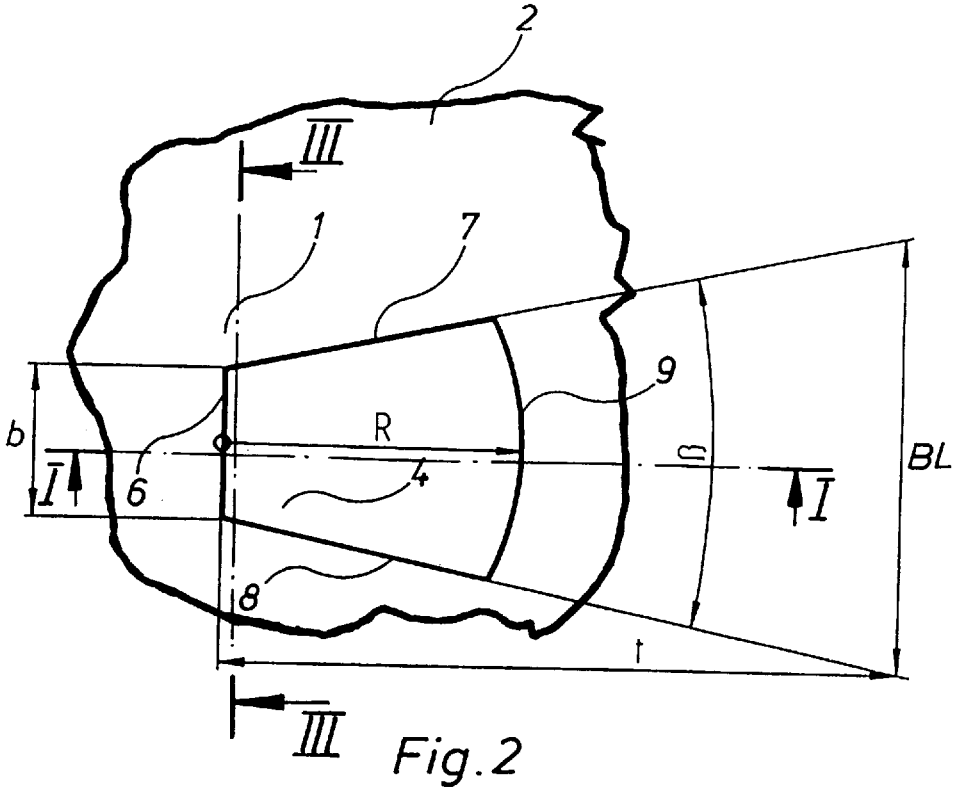
FIG. 2 is a top view of the portion represented in FIG. 1.
Figure 3:
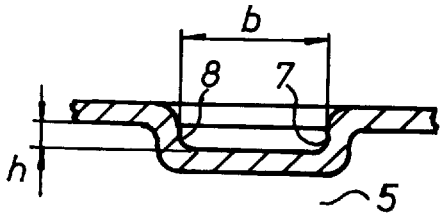
FIG. 3 is a section through the device in accordance with the invention in the area of a nozzle in the transverse direction.

A nozzle 1 employed in the device in accordance with the invention will be described in more detail by means of FIGS. 1 to 3:

The nozzle 1 has been placed in a closed guidance surface 2 of a blowing chamber 5 extending along a conveying path of a sheet 3. For example, a straight cut of the width b is made by means of a deep drawing tool in the surface 2, and at the same time a nozzle guide surface 4, which extends downward at an angle alpha of 2° to 6° into the blowing chamber 5, is formed.

The nozzle 1 produced in this manner has a blower opening 6 with a cross-sectional air outlet surface A resulting from the height h and the width b. The width b and the height h are at a ratio of b/h=5 to 10, and the width b can be 5 to 20 mm. The flow of a gaseous medium, for example air, is guided along the guide nozzle surface 4, starting at the blower opening 6. This nozzle guide surface 4 is bounded by the blower opening 6; by two edges 7 and 8, which are diverging at an opening angle beta of 20° to 50° in relation to the longitudinal line of the section 6; and by a circular arc-shaped transition 9 with the radius R (R/b−1 to 3), located opposite the blower opening b from the guide surface 4 to the guidance surface 2. The diverging edges 7 and 8 form closed lateral surfaces between the guidance surface 2 and the nozzle guide surface 4 extending downward in respect to the guidance surface 2. By means of this, a flat jet nozzle results as the nozzle 1, with a directed, slightly divergent jet. This nozzle 1 is charged with a pressure of 100 to 500 PA. In the instant case, air, or air enriched with a solvent or water, is used as the gaseous medium.

Figure 4:
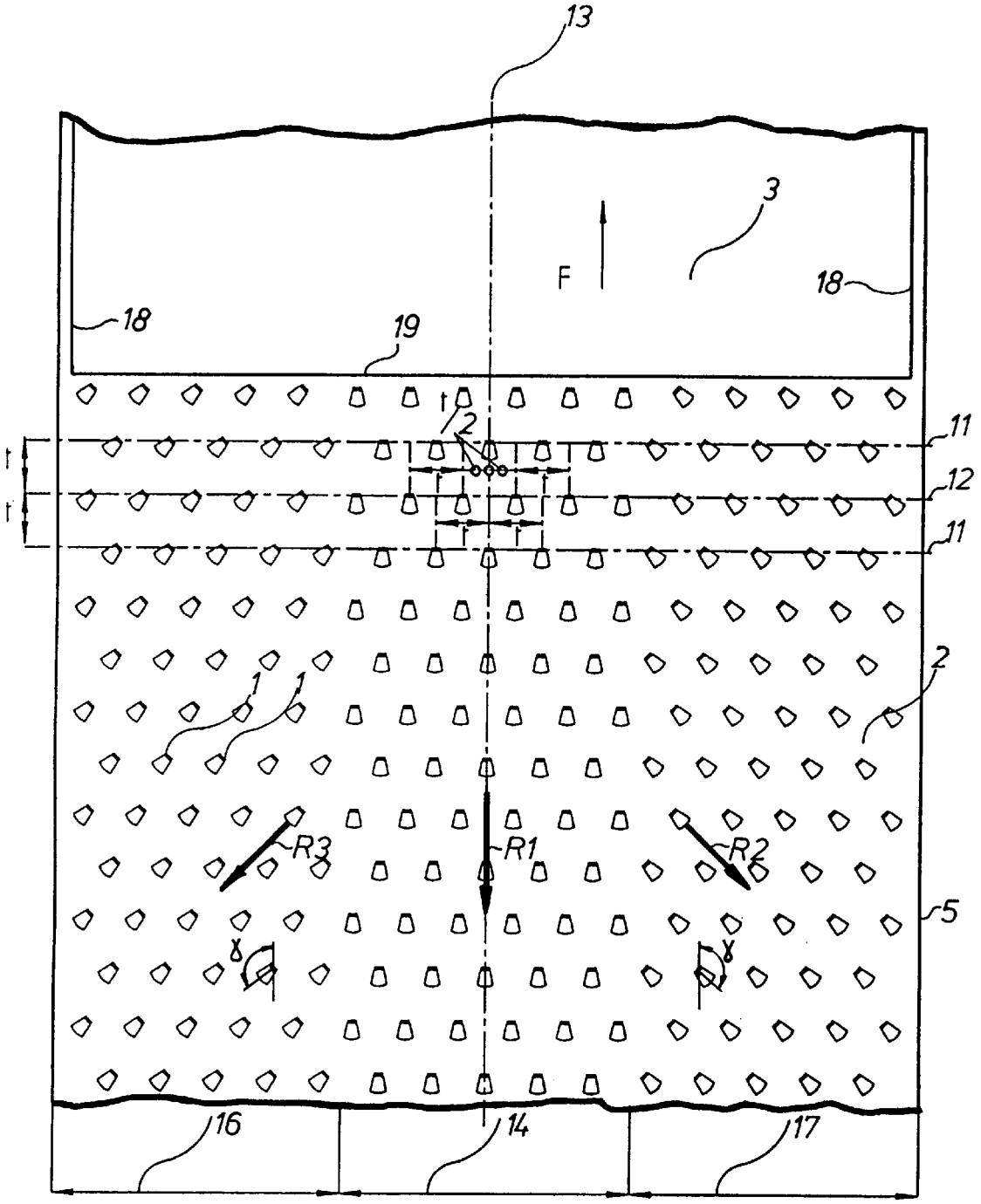
FIG. 4 is a top view over the entire width of the device in accordance with the present invention in a first exemplary embodiment.

A first preferred exemplary embodiment, in the form of a plurality of the above described nozzles 1 in an arrangement over the width and length of the guidance surface 2, is represented in FIG. 4. In respect to an axis of symmetry 13 extending in the conveying direction F, the nozzles 1 are symmetrically disposed transverse rows and have a division t or spacing in each transverse row. Two successive rows of nozzles 11, 12 extending over the width of the guidance surface 2, are offset and from each other by half a division t in respect to an axis of symmetry 13 extending along the conveying direction F. The division t results as a function of the opening angle beta which determines a width BL of the air jet at the distance of the division t from the blower opening. The ratio of the division t to a width BL of the air jet preferably is approximately t/BL 1 to 2. The total surface of the blower openings 6 is 0.1% to 1% of the surface of the guidance surface 2.

By means of the arrangement of the nozzles 1 over its width, the guidance surface 2 is divided into three zones 14, 16, and 17. A central stabilization zone 14 is symmetrically located on both sides of the longitudinal axis of symmetry 13 tightening zone 16 or 17 of the two tightening zones 16 and 17 adjoins the central stabilization zone 14.

The nozzles 1 in the stabilization zone 14 are oriented facing opposite the sheet conveying direction F, while in the two tightening zones 16 and 17 the longitudinal center axles of the nozzles 1, together with the conveying direction F, enclose an angle gamma of 120° to 150°, which in the first example is 135°, and which is oriented away from the axis of symmetry 13. Here the direction of blowing is approximately oriented toward the trailing edges 18 and 19 of the sheet 3.

Thus, ensuing resultants R1, R2, R3 of the blowing direction of the nozzles 1 point opposite to the conveying direction F in the stabilization zone 14, and in the two tightening zones 16 and 17 and point approximately toward the trailing edges 18, 19 of the sheet 3.

Figure 5:
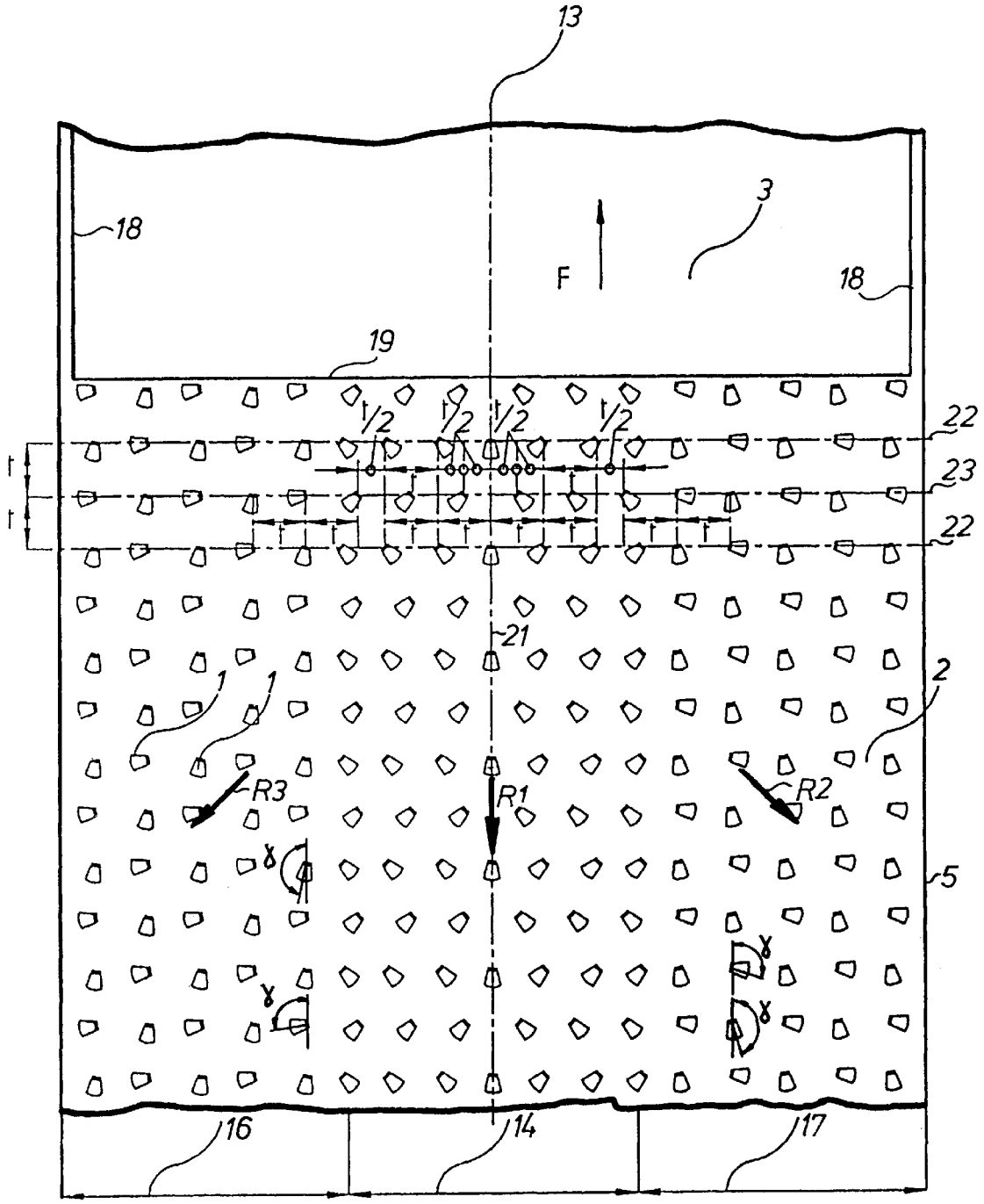
FIG. 5 is a top view corresponding to FIG. 4 of a second preferred embodiment.

In the second preferred embodiment of the present invention, as is represented in FIG. 5, the stabilization zone 14 and tightening zones 16 and 17 are also provided. However, in this second embodiment the nozzle rows 22 and 23 in the two tightening zones 16 and 17 are not offset by one half division t with respect to each other.

The stabilization zone 14 is here constituted by a single longitudinal nozzle row 21 extending on the axis of symmetry 13 and, at whose the adjacent nozzles in each of the successive tranverse nozzles rows 22, 23 have been inserted which alternately blow towards and away in respect to the axis of symmetry 13 at an angle of 45°, but opposite to the conveying direction F. In the tightening zones 16 and 17, the longitudinal axes of the nozzles 1, together with the conveying direction F, enclose an angle gamma changing from 100° to 120° or 160° to 170° pointing away from the axis of symmetry 13.

It is common to both nozzle arrangements in depicted in FIG. 4 and in FIG. 5, that the ratio of the division t to the width BL of the air jet as a function of the opening angle beta is t/BL=1 to 2. The resultant R1 of the blowing directions of the stabilization zone 14 extend parallel and opposite the conveying direction F, while in the tightening zones 16, 17 the resultants R2, R3, together with the conveying direction F, enclose an angle of 135° pointed away from the axis of symmetry 14.

It is achieved by means of the nozzle arrangement in both embodiments, that a succeeding nozzle 1 is associated with each preceding nozzle 1 and blows into the rear area of the preceding nozzle 1. No continuous straight flow can be created in the tightening zones 16 and 17 by the nozzle arrangement in accordance with FIG. 5, since each nozzle 1 is associated with a second nozzle 1 blowing approximately perpendicularly in respect to the first, which laterally deflects the blowing jet of the first nozzle 1.

In an advantageous manner, the width of the stabilization zone 14 is less than the smallest size of the sheets 3 to be guided, while the width of the closed guidance surface 2 should be greater than the largest size of the sheets to be guided.

In the instant example, the maximum width of the sheet 3 is approximately 1000 mm, the minimum width of the sheet 3 approximately 500 mm and the width of the guidance surface 2 approximately 1100 mm. The length of the guidance surface extends along the sheet conveyance path, for example between two printing units or between a printing unit and a delivery device of a rotary printing press.

While preferred embodiments of a device for the suspended guidance of sheets or webs in accordance with the present invention have been set forth fully and completely hereinabove, it will be apparent to one of skill in the art that a number of changes in, for example, the type of press being used, the source of the compressed air, the material used to form the guidance surface and the like may be made without departing from the true spirit and scope of the present invention which is accordingly to be limited to the following claims.

We claim:

1. A device for the suspended guidance of sheets or webs in a processing machine such as a rotary printing press comprising:

a closed guidance surface facing sheets or webs being guided in a conveying direction and having a longitudinal axis of symmetry;

a plurality of air discharge nozzles formed in said guidance surface, each of said nozzles having a nozzle blower opening with a longitudinal axis; and at least a central stabilization zone located symmetrically to said longitudinal axis of symmetry and two tightening zones adjoining said stabilization zone, said zones being defined in said closed guidance surface by said air discharge nozzles, said nozzles in said tightening zones being alternatingly positioned so that said longitudinal axis of each said nozzle blower opening and said conveying direction alternatingly enclose an angle of 100° to 120° and 160° to 170° with said nozzles being arranged so that they blow away from said longitudinal axis of symmetry.

2. The device of claim 1 wherein in said stabilization zone said nozzles are alternatingly arranged in first transverse rows blowing toward said axis of symmetry and in second transverse rows blowing away from said axis of symmetry and further wherein a resultant of blowing directions of said nozzles in said stabilization zone extends generally parallel to and opposite said conveying direction.

3. The device of claim 2 wherein said nozzles in said stabilization zone are arranged so that they alternatingly blow toward and away from said longitudinal axis of symmetry at an angle of approximately 45°.

4. The device of claim 1 wherein each of said nozzle blower openings has an air outlet opening and a diverging obliquely downwardly extending air guide surface adjoining said outlet opening, said air guide surface being bounded by lateral edges and an arc-shaped transition, said lateral edges enclosing an opening angle between 20°and 50°.

5. The device of claim 1 wherein each said nozzle is associated with a succeeding nozzle which blows into the rear of its associated preceding nozzle.

6. The device of claim 1 wherein a total area of said blower openings is between 0.1% to 1.0% of a surface area of said guidance surface.

* * * * *